US007013912B1

(12) United States Patent
Machi

(10) Patent No.: US 7,013,912 B1
(45) Date of Patent: Mar. 21, 2006

(54) APPARATUS AND SYSTEM FOR UTILITY WASTE AND VENTING

(76) Inventor: Eugene R. Machi, 873 Mountain View Dr., Lafayette, CA (US) 94549

( * ) Notice: Subject to any disclaimer, the term of this patent is extended or adjusted under 35 U.S.C. 154(b) by 0 days.

(21) Appl. No.: 11/103,189

(22) Filed: Apr. 11, 2005

Related U.S. Application Data

(62) Division of application No. 10/657,515, filed on Sep. 8, 2003.

(51) Int. Cl.
*F16L 5/00* (2006.01)

(52) U.S. Cl. ..... 137/357; 137/362; 52/302.1; 52/302.3

(58) Field of Classification Search ..... 137/357, 137/362; 52/302.1, 302.3
See application file for complete search history.

(56) References Cited

U.S. PATENT DOCUMENTS

| | | | | | |
|---|---|---|---|---|---|
| 897,233 | A | * | 8/1908 | Pruin | 379/316 |
| 1,201,081 | A | * | 10/1916 | Nilson | 4/211 |
| 3,281,866 | A | * | 11/1966 | Palowsky | 4/211 |
| 3,774,631 | A | * | 11/1973 | Willkins | 137/357 |
| 5,209,254 | A | * | 5/1993 | Ancselovics | 137/87.02 |
| 5,515,883 | A | * | 5/1996 | Bouzaglou | 137/357 |

* cited by examiner

*Primary Examiner*—A. Michael Chambers
(74) *Attorney, Agent, or Firm*—Charles L. Thoeming

(57) ABSTRACT

An improved high rise building drainage system method and apparatus for conducting waste water from plumbing fixtures, such as lavatories and the like, through prefabricated, modular waste-vent stack units extending through intervals and stack boxes for such units optimally located to minimize the footprint through each interval.

16 Claims, 7 Drawing Sheets

APPARATUS AND SYSTEM FOR UTILITY WASTE AND VENTING

CROSS-REFERENCES TO RELATED APPLICATIONS

This patent application is a divisional utility patent application of previously filed and pending U.S. non-provisional patent application Ser. No. 10/657,515 filed on 8 Sep. 2003, as allowed under 35 U.S.C. §121.

STATEMENT REGARDING FEDERALLY SPONSORED RESEARCH OR DEVELOPMENT

None.

REFERENCE TO A MICRO-FICHE APPENDIX

None.

BACKGROUND OF THE INVENTION

1. Field of the Invention

This invention relates to plumbing installation in high rise construction projects, and more particularly to an improved method, system, and apparatus for optimally locating collecting and venting stacks for handling plumbing waste.

2. Description of the Related Art

A preliminary search of the prior art located the following United States patents which are believed to be representative of the present state of the prior art: U.S. Pat. No. 5,197,766, issued Mar. 30, 1993, U.S. Pat. No. 5,243,716, issued Sep. 14, 1993, U.S. Pat. No. 5,037,541, issued Aug. 6, 1991, U.S. Pat. No. 3,346,887, issued Oct. 17, 1967, U.S. Pat. No. 4,449,741, issued May 22, 1984, U.S. Pat. No. 4,919,164, issued Apr. 24, 1990, and U.S. Pat. No. 3,894,302, issued Jul. 15, 1975.

Collection and disposal of plumbing waste and the associated venting required to accompany waste collection are well established in the building construction art. Installation methods have typically followed these developments within the uniform building codes for specific venues.

High rise, multistoried dwelling structures are commonly designed with redundant or duplicative plumbing layouts for each floor of the structure. The waste from various plumbing fixtures for each layout are arranged to discharge into common waste stacks and are vented into common vent stacks.

Without regard for contract parameters, installation of high rise plumbing networks is by necessity labor intensive and by design materially wasteful. Typical high rise contract plans over specify the number of plumbing risers to accommodate inefficient fixture placement or orientation. These risers typically flow from floor to floor through individual cans. At the same time, inefficiencies in contract fixture design or placement eliminate the possibility of prefabricating plumbing risers which would readily reduce labor and material costs for plumbing waste and vent riser installation.

Plumbing risers in the art also present physical barriers for associated building trades. For example, the code requirements for post-tension structural cables in particular areas places a premium on floor surface area for laying out these post-tension cables. Excessive grouping of, or overlarge, plumbing stacks makes meeting the structural code requirements in such high rise projects more costly and time consuming. Similarly, use of individual cans for the plumbing stacks results in larger floor surface area devoted to the plumbing risers or stacks. The presence of excessive plumbing stacks also greatly increases the acoustic and fireproofing cost requirements in related construction trades, resulting in overall higher project costs.

It is, therefore, an object of the present invention to provide an improved method, system, and apparatus for combining waste and vent stacks into one system with a minimum footprint on the floor surface area.

It is a further objective of the present invention to provide an improved method, system, and apparatus for prefabrication and installation of high rise plumbing waste and vent stacks which would reduce the labor and material costs for installation of the same.

Yet another objective of the present invention is to provide an improved method, system, and apparatus for combining waste and vent stacks which saves contract project bid costs for the plumbing trades.

Another objective of the present invention is to provide an improved method, system, and apparatus for combining waste and vent stacks which reduces costs for acoustic requirements on high rise construction projects.

Another objective of the present invention is to provide an improved method, system, and apparatus for combining waste and vent stacks which reduces costs for structural requirements on high rise construction projects.

Another objective of the present invention is to provide an improved method, system, and apparatus for combining waste and vent stacks which reduces costs for fire proofing requirements on high rise construction projects.

Yet another objective of the present invention is to facilitate installation of auxiliary piping, electrical and other utility hangers within the construction project by elimination of redundant or unnecessary waste and vent stacks.

Further objects and advantages of this invention will become apparent to one skilled in the art according to the description of the invention as follows.

BRIEF SUMMARY OF THE INVENTION

In the present invention, waste and vent stacks for high rise, multi-storied dwelling structure construction are combined into one system which contains each stack in one box instead of individual cans. The plumbing contract drawings and specifications are reviewed to determine which plumbing stacks can be consolidated into groups and unified into one stack. The newly consolidated plumbing stacks are oriented on the contract drawings to pick up all fixtures which have been color coded by type. The newly consolidated plumbing stacks are de-constructed to provide a revised material list. Architectural drawings for the project are checked to insure no interference with structural requirements. Pre-fabrication drawings by material type are developed and each stack is given a reference number. Special stack requirements are designated for each stack. All stack elements per floor are pre-fabricated with the waste riser consistently on the same side of the stack element box. A pre-fabrication and installation book is prepared and finalized wherein the main distribution piping is coordinated to match up with the pre-fabricated system. Color-code to stack type is established and the job site is pre-labeled accordingly. The pre-fabricated system waste and vent stack boxes are then quickly and readily installed in ascending intervals.

The improved apparatus of the present invention provides a smaller foot-print on the floor surface area, and eliminates many unnecessary waste/vent stacks through consolidation. For example, a typical water closet, lavatory and bath tub fixture group with individual cans for the plumbing riser would require at least forty-four inches in length. The system waste and vent stack box of the present invention requires only twenty-eight inches in length for the same riser.

Other features, advantages, and objects of the present invention will become apparent with reference to the following description and accompanying drawings.

BRIEF DESCRIPTION OF DRAWINGS

These and other objects, advantages and novel features of the invention will be more readily appreciated from the following detailed description when read in conjunction with the following drawings, in which.

For purposes of this application, a waste stack shall mean the vertical extension of a building drain as a main artery of a drainage system. Waste conveys liquid and fecal matter.

For purposes of this application, a vent stack is the main artery of a vent system which begins below the lowest waste branch interval, connects to a waste stack, and terminates at the stack vent.

For purposes of this application, combined waste and vent shall mean an entire arrangement of waste and vent system conveying waste and which allows proper airflow through the system.

For purposes of this application, every floor of a high rise, multi-story structure or a vertical distance of 8 to 10 feet (depending on the particular code followed in the respective jurisdiction) is considered an interval.

DETAILED DESCRIPTION OF THE INVENTION

The novel method of the present invention for installing new high rise construction utility waste and vent system plumbing stacks begins with review of the high rise construction plans to locate the contract plumbing risers as designed and specified therein. Once all such risers have been located and so identified, the next step is to determine an optimum placement of alternative plumbing risers within the high rise contract plans and specifications for reduced material and labor considerations, improved acoustical considerations, and improved structural considerations. After the alternative plumbing risers have been placed within the contract plans, contract fixture alignment is adjusted, if necessary, to facilitate optimum placement of alternative plumbing risers.

When all fixtures have been adjusted to accommodate the optimum placement of alternative plumbing risers, contract plumbing stacks are consolidated into optimal groups and one stack. Following this process, the newly consolidated plumbing system stacks are located in the contract wall plans, and are identified by number and type of materials used. The newly consolidated plumbing system stacks are further grouped by color coding according to types of materials used therein.

Once the newly designed system stacks are thus classified, the newly consolidated plumbing system stacks are drawn up with the waste riser flow lines consistently on the same stack side facing the stack placement in the wall. A material list is generated for each new consolidated plumbing system stack, and proper stack box sizes, corresponding with the newly consolidated plumbing system stacks, are assigned according to the present invention. At this time, the architectural drawings are reviewed to verify proper clearance for the newly consolidated plumbing system stacks, and request for information for walls that may need to be widened to fit the newly consolidated plumbing system stacks is sought.

Figure 4:
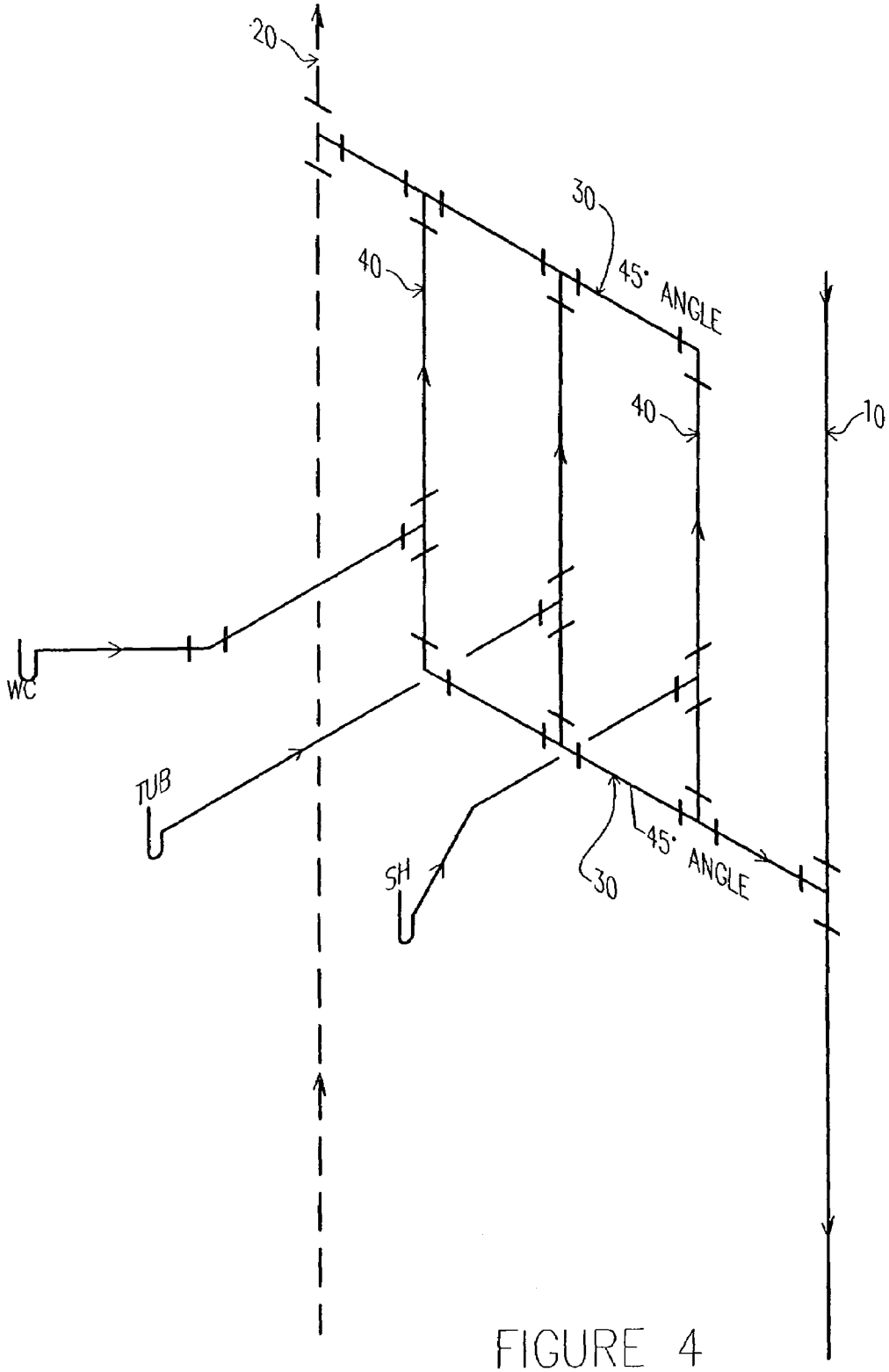
FIG. 4 is an elevational schematic view of a typical waste-vent stack according to the present invention.
Figure 7:
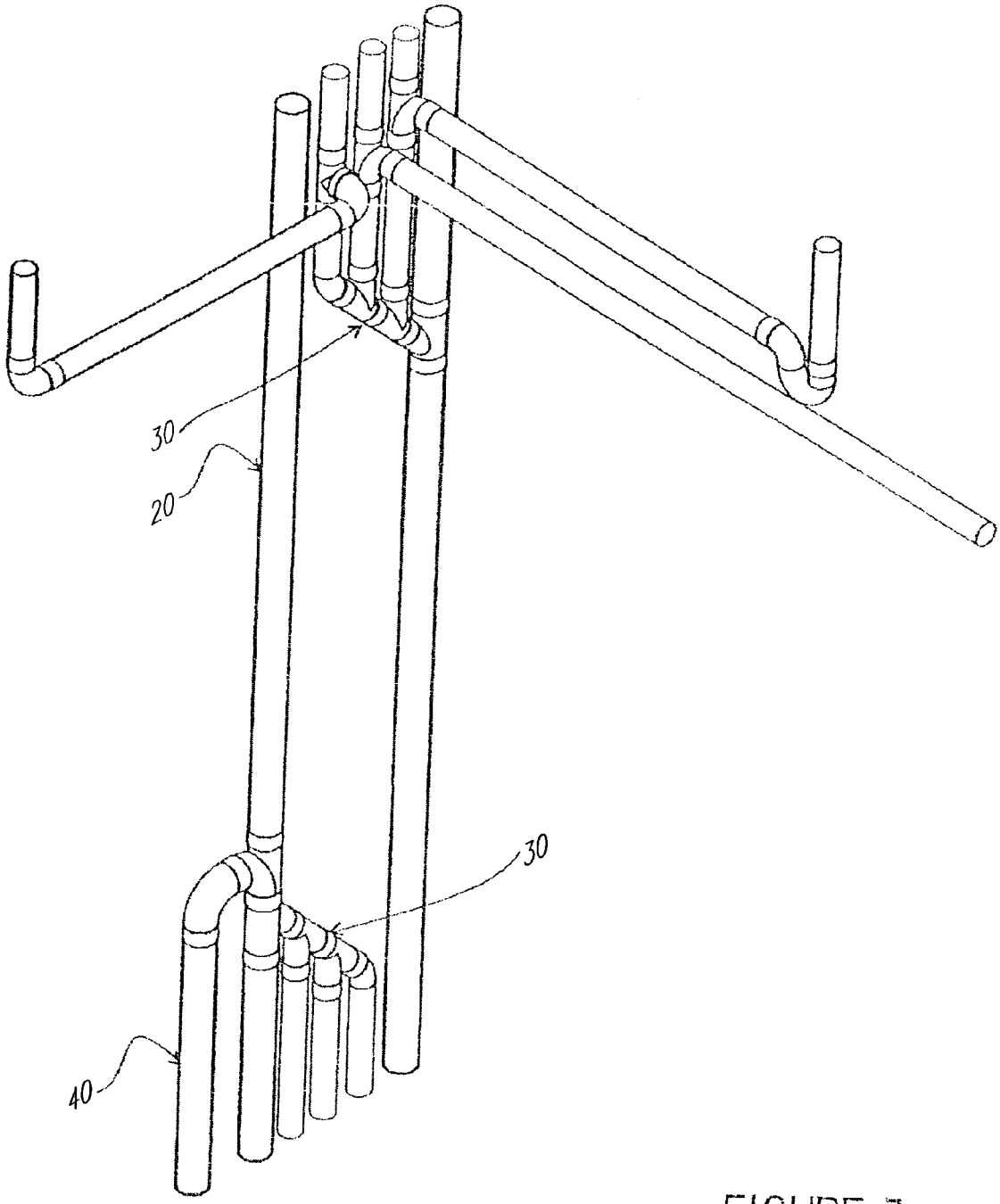
FIG. 7 is an elevational perspective view of a typical waste-vent stack within an interval according to the present invention.

Pre-fabrication drawings by types of material for each newly consolidated plumbing system stack, typified by example in FIGS. 4 and 7, are then developed by:

1) numbering each newly consolidated plumbing system stack;
2) identifying any special stack in the newly consolidated plumbing system stacks;
3) finalizing pre-fabrication drawings;
4) preparing a pre-fabrication book to coordinate main distribution piping to match up with the newly consolidated plumbing system stacks;
5) establishing color coding to stack type within the newly consolidated plumbing system stacks; and
6) pre-labeling the construction job-site.

Figure 1:
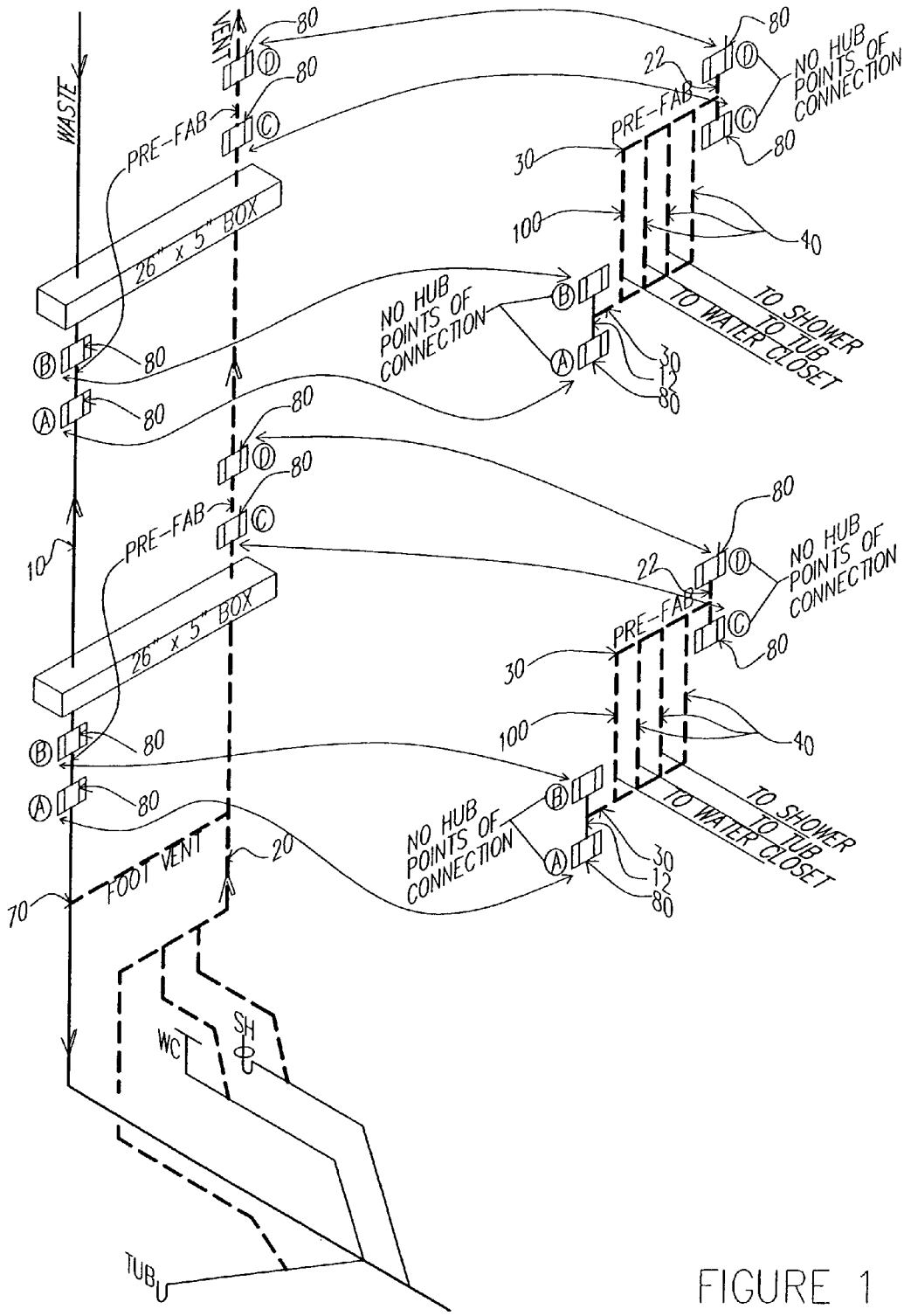
FIG. 1 is an elevational perspective view of uninstalled pre-fabricated waste-vent stack units according to the present invention in relation to a typical waste-vent stack for several intervals of a standard high rise structure.
Figure 2:
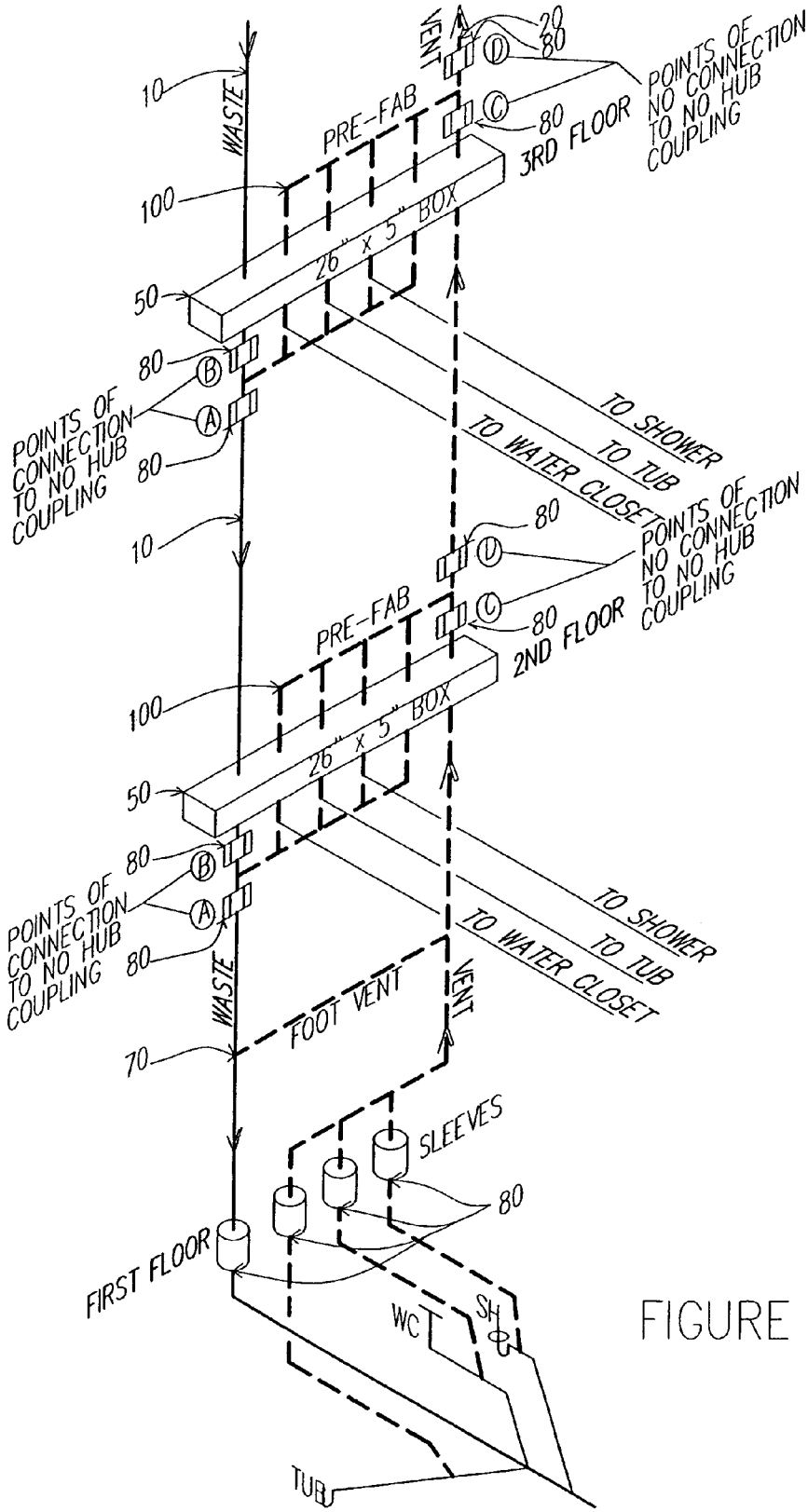
FIG. 2 is an elevational schematic view of the installed pre-fabricated waste and vent stack box system of the present invention for several intervals of a standard high rise structure.
Figure 5:
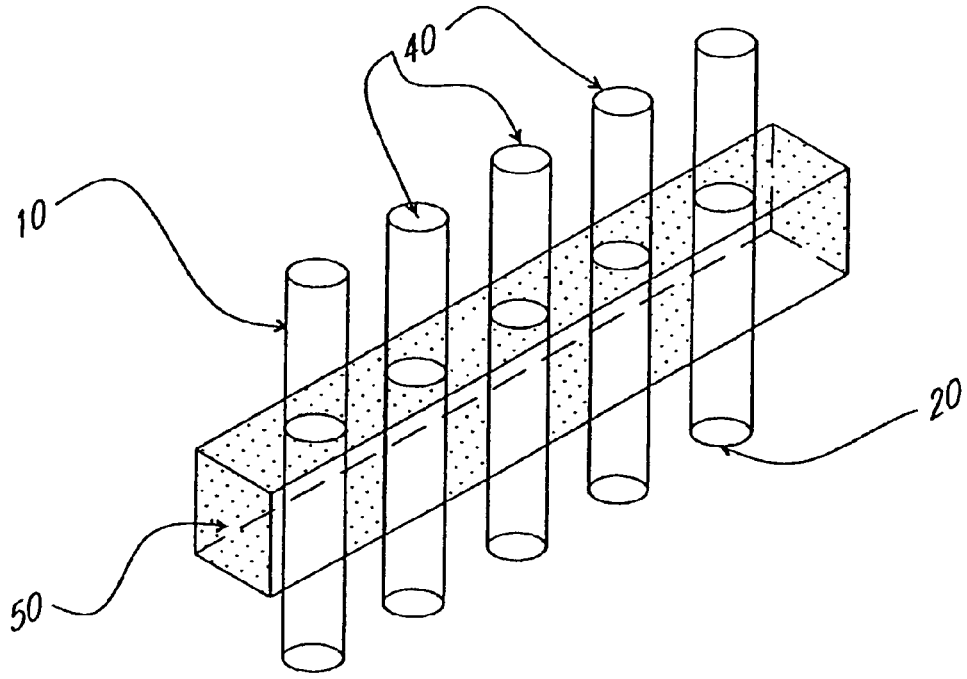
FIG. 5 is a perspective view of the interval box according to the present invention.

Once the pre-fabricated drawings are finalized, the separate waste-vent stacks, FIGS. 1, 2, and 4, and stack boxes for each interval, FIGS. 1, 2 and 5, are fabricated according to the present invention and installed according to the alternative riser plans and specifications.

As shown in FIGS. 1 and 2, plumbing risers located in alternative positions than the risers according to the contract plans are depicted by a typical waste riser 10 and a vent riser 20. Pre-fabricated waste and vent system plumbing stacks 100 are assembled and located within the high rise construction project according to the color-coding and numbering system of the present invention so that the points of connection 80 to the waste and vent risers are according to the method and system of the present invention.

Figure 3:
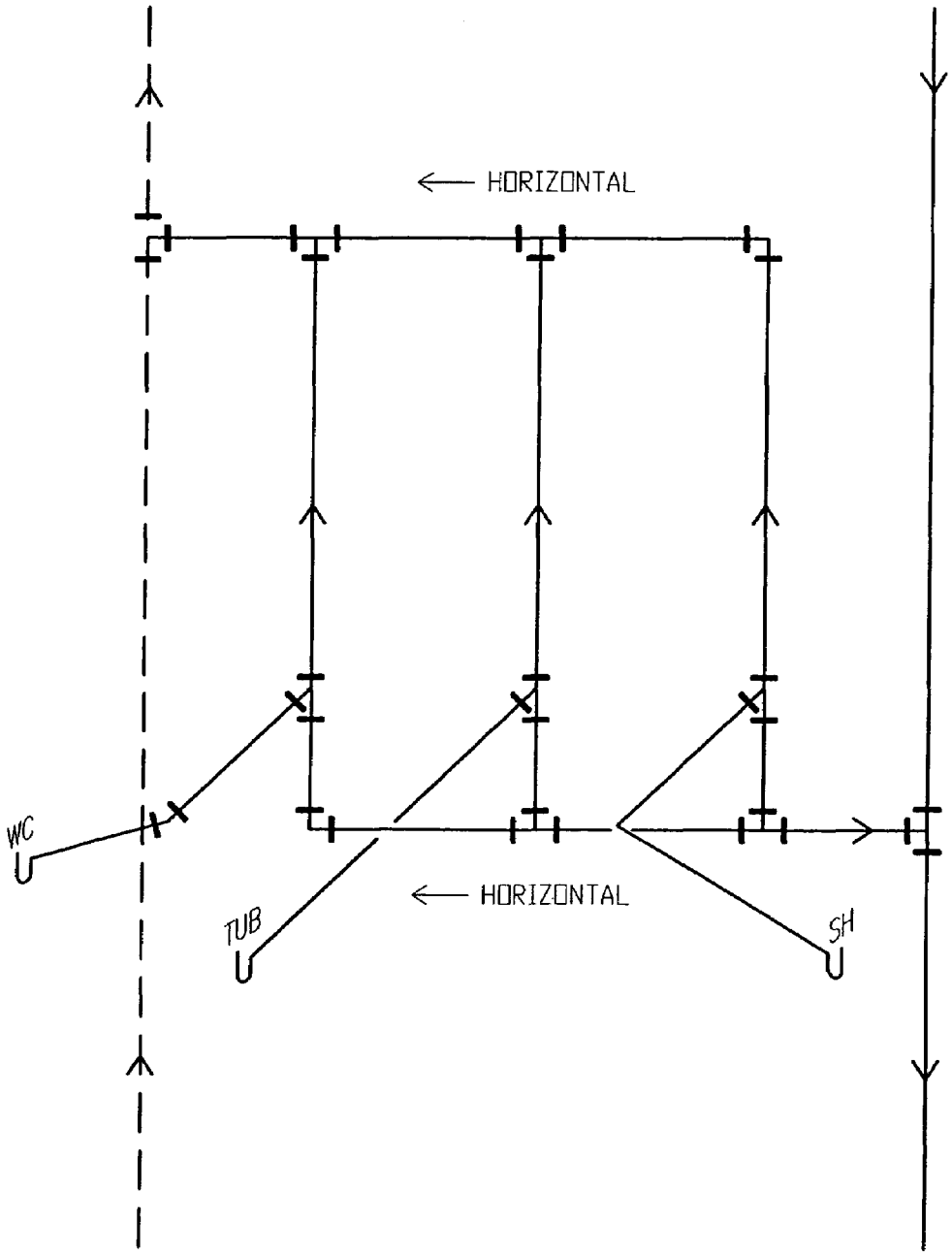
FIG. 3 is an elevational schematic view of a typical waste-vent stack in the art.

As shown in FIGS. 1, 2, and 4, each waste and vent system plumbing stack 100 comprises an upper end, a lower end, a right side facing the stack from inside the building, and a left side facing the stack from inside the building, and a plurality of segments. These waste and vent system plumbing stack 100 segments include a waste riser 12 and a stack vent riser 22 which are selectively sized and fabricated to readily fit into the system waste riser 10 and vent riser 20 at hub-less points of connection 80. The stack waste riser 12 and the stack vent riser 22 are pre-fabricated uniformly so that each respective riser is located on the same waste and vent system plumbing stack 100 side relative to the system waste riser 10 and vent riser 20. The waste and vent system plumbing stack 100 further comprises a plurality of connectors 30 between the stack waste riser 12 and the stack vent riser 22 wherein the connectors are disposed either perpendicular to the stack vent riser and stack waste riser or at forty-five degree angles thereto with the stack vent riser attachments to each connector being higher relative to the stack waste riser attachment for each corresponding connector, FIGS. 4 and 7. Conventional stacks in the art do not use these angular connections, FIG. 3, and thus are less compact. Within each waste and vent system plumbing stack 100 are a plurality of branch pipes 40 connected to one or more fixtures which discharge waste water. Each branch pipe 40 is further connected at one end thereof by fittings to the stack through one of the connectors 30 to the stack vent riser 20 and the stack waste riser 10, as further depicted in FIGS. 4 and 7. This unitary, prefabrication construction of waste and vent system plumbing stack 100 units facilitates installation of auxiliary piping, electrical, and other utility hangers within the construction project by elimination of redundant or unnecessary waste and vent stacks.

The pre-fabricated waste and vent system plumbing stack 100 is contained in a stack box 50 once the stack 100 is installed through each interval, as depicted in FIG. 2. In this manner, the molded stack unit is contained in a box wherein the box length is determined by the number of plumbing fixtures served by the box and the box width is determined by the pipe diameters of the branch pipes 40, stack waste riser 10, and stack vent riser 20, as depicted in FIG. 5. A plurality of modular stack boxes 50 are correspondingly installed vertically and interconnected to the desired level of high rise construction, wherein each interval of high rise construction vent stack has at least one box.

Figure 6:
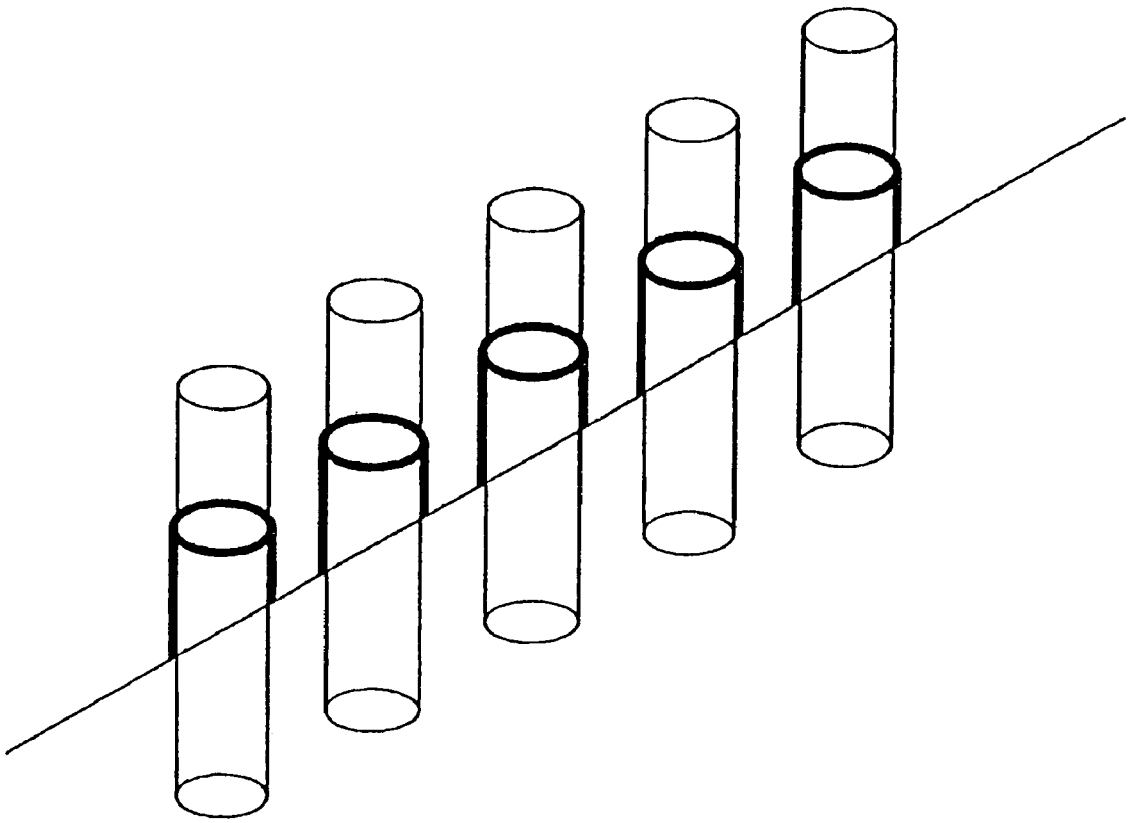
FIG. 6 is a perspective view of the interval cans in the art.

An example of stack box 50 sizing according to the present invention would be where the connectors 30 to the stack waste riser 10 and stack vent riser 20 are two inch diameter pipes on five inch center-lines. The stack vent riser 20 and stack waste riser 10 are each four inches in diameter on a three inch center-line from each respective edge of the stack box 50. For these dimensions, the stack box 50 would require a length of twenty-eight inches and a width of six inches. Typical water closet, lavatory and bath tub fixture groups in the art with individual cans for the plumbing riser would require at least forty-four inches in length using a separate can through each interval, as depicted in FIG. 6. The system waste and vent stack box of the present invention requires only twenty-eight inches in length for the same riser, FIG. 5. These dimensions are representative of a typical application of the present invention in high rise construction; however, sizing of the specific stack box 50 is a direct function of the stack connector and stack riser diameter sizing and placement within the stack box 50.

The reduced stack box 50 foot-print area on the high rise floor lessens the likelihood that structural requirements, such as post-tension structural cabling, would be effected. Further, acoustic requirements are more easily achieved by the smaller, and fewer in number, pre-fabricated waste and vent system plumbing stacks of the present invention. Costs for fire proofing requirements are minimized by use of the reduced stack box 50 since breaks per interval are reduced.

Material and labor savings are realized by molding branch pipes 40, connector fittings and connectors 30 are into the pre-fabricated waste and vent system plumbing stack 100 a stack of one unit at the junction of the stack waste riser 10 and stack vent riser 20, FIG. 7. The pre-fabricated waste and vent system plumbing stack 100 can be constructed of materials suitable for plumbing applications including, but not limited to, cast iron, high density polyethylene, DWV (drainage, waste and vent) copper pipe.

I claim:

1. Apparatus for high rise construction utility waste and vent system plumbing stacks within a building comprising:

means for a stack comprising an upper end, a lower end, a right side facing the stack from inside the building, and a left side facing the stack from inside the building, and a plurality of segments;

means for waste riser on one stack side;

means for vent riser on the stack side opposite the waste riser, wherein waste riser and vent riser placement are according to optimal plumbing layout;

means for a plurality of connectors between the waste riser and the vent riser wherein the connectors are disposed either perpendicular to the vent riser and waste riser or at forty-five degree angles thereto with the vent riser attachment being higher relative to the waste riser attachment for each connector; and means for plurality of branch pipes connected to one or more fixtures which discharge waste water, each of the branch pipes being further connected at one end thereof by fittings to the stack through one of the connectors to the vent riser and the waste riser.

2. The apparatus of claim 1 wherein branch pipes, connector fittings and connectors are molded into a stack of one unit at a junction of the waste riser and vent riser.

3. The apparatus of claim 2 wherein the molded stack unit is contained in means for housing a molded stack unit having a length dimension determined by the number of plumbing fixtures served by housing means and a width determined by pipe diameter.

4. The apparatus of claim 3 wherein means for housing a molded stack unit are correspondingly stacked vertically and interconnected to a desired interval level of high rise construction and wherein each interval has at least one housing means.

5. The apparatus of claim 2 wherein the connectors to the waste riser and vent riser are two inch diameter pipes on five inch center-lines.

6. The apparatus of claim 5 wherein molded stack unit is twenty-eight inches long and six inches wide.

7. The apparatus of claim 6 wherein the vent riser and waste riser are each four inches in diameter on a three inch center-line from each respective edge of molded stack unit.

8. The apparatus according to claim 1 wherein means for waste riser, means for vent riser, means for branch pipes, means for connector fittings and means for connectors are constructed of like materials wherein the materials are selected from the group consisting of cast iron, high density polyethylene, and DWV (drainage, waste and vent) copper pipe.

9. The apparatus according to claim 4 wherein means for waste riser, means for vent riser, means for branch pipes, means for connector fittings and means for connectors are constructed of like materials wherein the materials are selected from the group consisting of cast iron, high density polyethylene, and DWV (drainage, waste and vent) copper pipe.

10. The apparatus according to claim 7 wherein means for waste riser, means for vent riser, means for branch pipes, means for connector fittings and means for connectors are constructed of like materials wherein the materials are selected from the group consisting of cast iron, high density polyethylene, and DWV (drainage, waste and vent) copper pipe.

11. A modular plumbing stack comprising a stack housing comprising a box;

at least one vent riser vertically disposed within the housing box;

at least one waste riser vertically disposed within the housing box, whereby the vent riser and the waste riser are in parallel alignment perpendicular to a horizontal plane within the housing box;

a plurality of connectors between the waste riser and the vent riser wherein the connectors are disposed either perpendicular to the vent riser and waste riser or at forty-five degree angles thereto with the vent riser attachment being higher relative to the waste riser attachment for each connector; and a plurality of branch pipes connected to one or more fixtures which discharge waste water, each of the branch pipes being further connected at one end thereof by fittings to the stack through one of the connectors to the vent riser and the waste riser.

12. A high rise construction utility waste and vent system according to the modular plumbing stack of claim 11, comprising a plurality of stacks correspondingly connected vertically and interconnected to a desired interval level of high rise construction and wherein each interval has at least one housing box.

13. The apparatus according to claim 12 wherein the waste riser, vent riser, branch pipes, connector fittings and connectors are constructed of like materials wherein the materials are selected from the group consisting of cast iron, high density polyethylene, and DWV (drainage, waste and vent) copper pipe.

14. The system of claim 13, wherein the connectors to the waste riser and the vent riser are two inch diameter pipes on five inch center-lines.

15. The system of claim 14, wherein the housing box is twenty-eight inches long and six inches wide.

16. The system of claim 15, wherein the vent riser and waste riser are each four inches in diameter on a three inch center-line.

* * * * *